United States Patent [19]

Furukawa

[11] Patent Number: 4,536,284

[45] Date of Patent: Aug. 20, 1985

[54] CLASSIFIER

[75] Inventor: Toshio Furukawa, Chiba, Japan

[73] Assignee: Kikkoman Corporation, Chiba, Japan

[21] Appl. No.: 603,163

[22] Filed: Apr. 23, 1984

Related U.S. Application Data

[62] Division of Ser. No. 358,371, Mar. 10, 1982, Pat. No. 4,461,702.

[30] Foreign Application Priority Data

Mar. 16, 1981 [JP] Japan ..... 56-37615

[51] Int. Cl.[3] ..... B07B 1/20

[52] U.S. Cl. ..... 209/305; 209/380

[58] Field of Search ..... 55/203, 302, 341 NT, 55/294, 341 R, 328, 432; 209/300, 305, 295, 380; 210/333.01

[56] References Cited

U.S. PATENT DOCUMENTS

| | | | |
|---|---|---|---|
| 1,944,267 | 1/1934 | Rathburn | 55/294 |
| 2,758,671 | 8/1956 | Silverman | 55/294 |
| 3,303,636 | 2/1967 | Liel | 55/294 |
| 3,568,414 | 3/1971 | Spriggs | 55/294 |
| 3,884,657 | 5/1975 | Rebours et al. | 55/302 |
| 3,977,847 | 8/1976 | Clark | 55/302 |
| 4,310,412 | 1/1982 | Murakami et al. | 209/301 |

FOREIGN PATENT DOCUMENTS

| | | | |
|---|---|---|---|
| 122982 | 8/1901 | Fed. Rep. of Germany | 55/341 M |
| 731109 | 7/1943 | Fed. Rep. of Germany | 55/302 |
| 1293547 | 4/1969 | Fed. Rep. of Germany | 55/302 |
| 326831 | 11/1902 | France | 55/302 |
| 724927 | 2/1955 | United Kingdom | 55/302 |

*Primary Examiner*—Bernard Nozick

*Attorney, Agent, or Firm*—Irving M. Weiner; Pamela S. Burt

[57] ABSTRACT

A classifier for separating particulate matter into relatively coarse and fine particles. The classifier includes a casing, at least one cylindrical screen assembly mounted in the casing and extending substantially in the direction in which the particulate matter flows in the casing for forcing the fine particles to traverse the cylindrical screen assembly, and at least one air purge pipe disposed in the casing for blowing air against the screen assembly to remove particles off the latter screen assembly, the cylindrical screen assembly and the air purge pipe being relatively movable by a drive mechanism. The cylindrical screen assembly has an increased degree of mechanical strength and rigidity, and provides a wide effective area available for screening.

8 Claims, 15 Drawing Figures

CLASSIFIER

This is a divisional of application Ser. No. 358,371 filed Mar. 10, 1982 now U.S. Pat. No. 4,461,702.

BACKGROUND OF THE INVENTION

1. Field of the Invention

The present invention relates to a classifier for separating particulate matter into coarse and fine particles.

2. Description of Relevant Art

Known forms of various classifiers include classifying screens which are of a flat construction. The prior classifiers have been unsatisfactory in that the flat screen provides a relatively small effective screening area and hence a poor handling capacity, and has a small degree of mechanical strength and rigidity. With insufficient rigidity, the screen tends to flex during operation and is unable to classify particles with high precision. An impeller for drawing fine particles is disposed behind the screen and can be a source of contamination when fine particles, having passed through the screen, are deposited on the impeller. The particulate deposits cause the impeller to be eroded and corroded, and act as localized or unbalanced weights to vibrate the impeller while the latter is rotating.

SUMMARY OF THE INVENTION

It is an object of the present invention to provide a classifier having cylindrical classifying screens of an increased mechanical strength and rigidity, which provide a relatively wide effective area available for screening.

Another object of the present invention is to provide a classifier having air purge pipes movable relative to classifying screens for blowing particles off the screens to prevent the latter from being clogged.

Still another object of the present invention is to provide a classifier which is of high processing capacity and increased accuracy of classification.

A still further object of the present invention is to provide a classifier which can be operated in either a pressurized or vacuumized system, and hence can be installed in any desired location in a classification process.

A still further object of the present invention is to provide a classifier having in its casing no pressurization mechanism such as an air blower or impeller, and which is thus free from particulate deposits and hence does not constitute a source of vibration, noise and contamination.

According to the present invention, a classifier comprises at least one cylindrical screen assembly disposed in a classifier casing for separating particulate matter introduced in the casing into coarse particles and fine particles, and at least one air purge pipe connected to a source of compressed air and having an opening such as a slot facing the screen assembly. The screen assembly and the air purge pipe are relatively movable by a drive mechanism. The cylindrical screen assembly extends in a direction parallel to that of flow of the particulate matter such that the fine particles are forced to traverse the screen assembly while the coarse particles are permitted to flow down directly toward a discharge port. With the cylindrical screen assembly thus arranged, it can withstand severe stresses during operation and provides a relatively wide effective area available for screening. The cylindrical screen assembly may be rotatably mounted in the casing and rotatable about its own axis by the drive mechanism, whereas the air purge pipe may be fixed to the casing with the slot extending the axial length of the screen. The air purge pipe may otherwise be disposed in the cylindrical screen assembly with the slot extending axially the length of the cylindrical screen assembly. Alternatively, the cylindrical screen assembly may be fixed to the casing with the air purge pipe being in the form of a ring disposed in the cylindrical screen assembly and having an annular slot defined in its outer peripheral wall in confronting relation to the screen assembly, the air purge pipe being movable by the drive mechanism up and down along the screen assembly. The air purge pipe may also extend circumferentially around the cylindrical screen assembly with an annular slot defined in its inner peripheral wall in confronting relation to the screen assembly.

The cylindrical screen assembly comprises a pair of upper and lower spaced screen retainers and a cylindrical screen extending between and affixed to the screen retainers. The upper and lower screen retainers may be interconnected by an axial connector tube which is rotatable about its own axis by the drive mechanism. As an alternative, the connector tube and the screen may be coupled together by upper and lower ribbed annular members so as to serve unitarily as a removable screen frame which is detachably fastened to the upper and lower screen retainers for easy replacement with other screen frames having different screen meshes.

The above and other objects, features and advantages of the present invention will become more apparent from the following description when read in conjunction with the accompanying drawings in which certain preferred embodiments are shown by way of illustrative example.

DETAILED DESCRIPTION OF PREFERRED EMBODIMENTS

Figure 15:
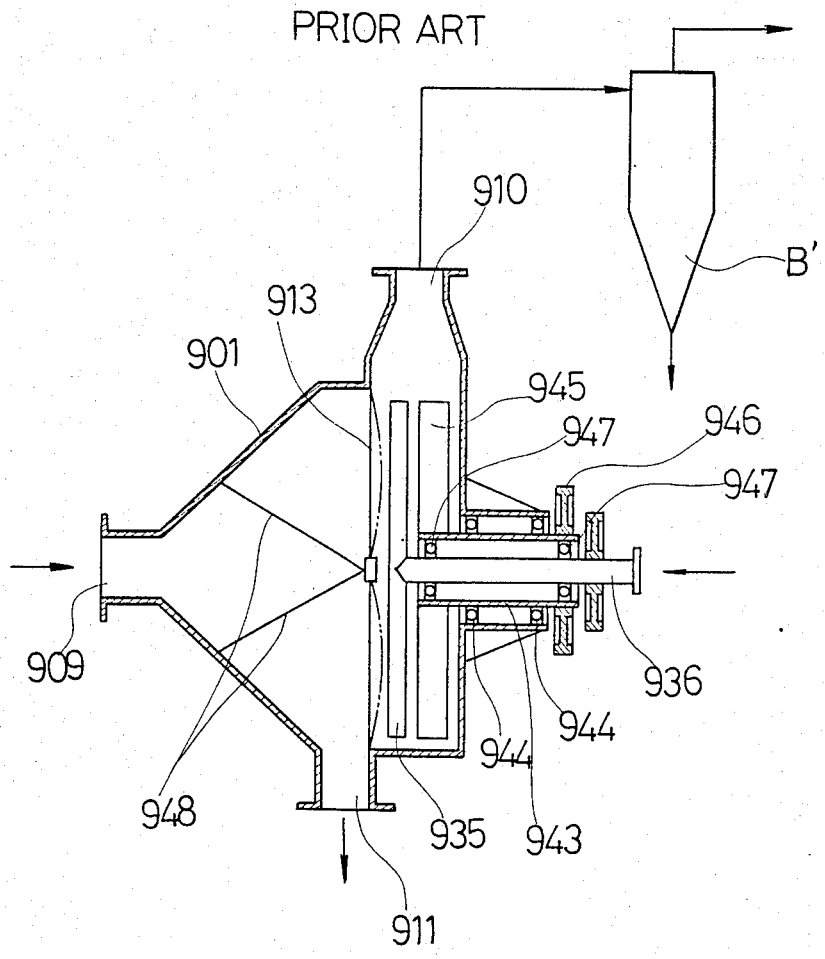
FIG. 15 is a cross-sectional view of a conventional classifier as coupled to a dust collector.

FIG. 15 shows one known type of classifier as disclosed in Japanese Utility Model Publication No. 54-25097.

The classifier comprises a casing 901 having an inlet port 909 for introducing particulate material, an outlet port 910 for discharging fine particles, and an outlet port 911 for discharging coarse particles. The casing 901 also has a hollow shaft 943 rotatably supported by a pair of bearings 944, 944 and having one end supporting an impeller 945 disposed in the casing 901 for corotation. The other end of the hollow shaft 943 has a pulley 946 located outside of the casing 901 and operatively coupled to a motor (not shown).

A connector pipe 936 extends axially through the hollow shaft 943 and is rotatably supported by a pair of bearings 947, 947, the connector pipe 936 supporting on its one end an air purge pipe 935 disposed in the casing 901 and in front of the impeller 945. The casing 901 also has therein a flat screen 913 of a predetermined mesh which is kept taut between the outlet ports 910, 911. The screen 913 has its central portion reinforced by a pair of reinforcements 948 connected to the casing 901.

In operation, the particulate matter to be separated is introduced into the casing 901 through the inlet port 909 when the impeller 945 rotates. Fine particles of particle sizes smaller than the mesh of the screen 913 are allowed to pass through the screen 913, and then flow into a dust collector or cyclone B′ in which the fine particles are separated from air. The fine particles are collected from the bottom of the cyclone B′, and air is discharged through the top of the cyclone B′. Coarse particles which are too large to pass through the screen 913 are discharged through the outlet port 911 of the classifier.

Because the screen 913 is of a flat construction, it provides a relatively small effective area available for screening with respect to the space within the casing 901, and hence is of a poor processing capacity. The flat screen 913 is also poor in mechanical strength and rigidity. The smaller the mesh of the screen 913, the smaller the diameter of the wires of the screen 913 and hence the poorer the rigidity of the screen 913. With insufficient rigidity, the screen 913 tends to flex rearwardly to the position shown by the broken lines as air flows upon rotation of the impeller 945. When the screen 913 is thus caused to flex, its mesh becomes larger than the initial mesh, a condition which makes it impossible to effect separation with desired high precision.

The prior classifier of the foregoing construction is also disadvantageous in that fine particles having passed through the screen 913 become deposited on the impeller 945, which then becomes a source of contamination or undergoes erosion and corrosion. Particulate deposits on the impeller 913 serve as localized or unbalanced weights which cause the impeller 913 to vibrate while the latter is rotating.

The present invention will now be described with reference to FIGS. 1 through 14.

Figure 1:
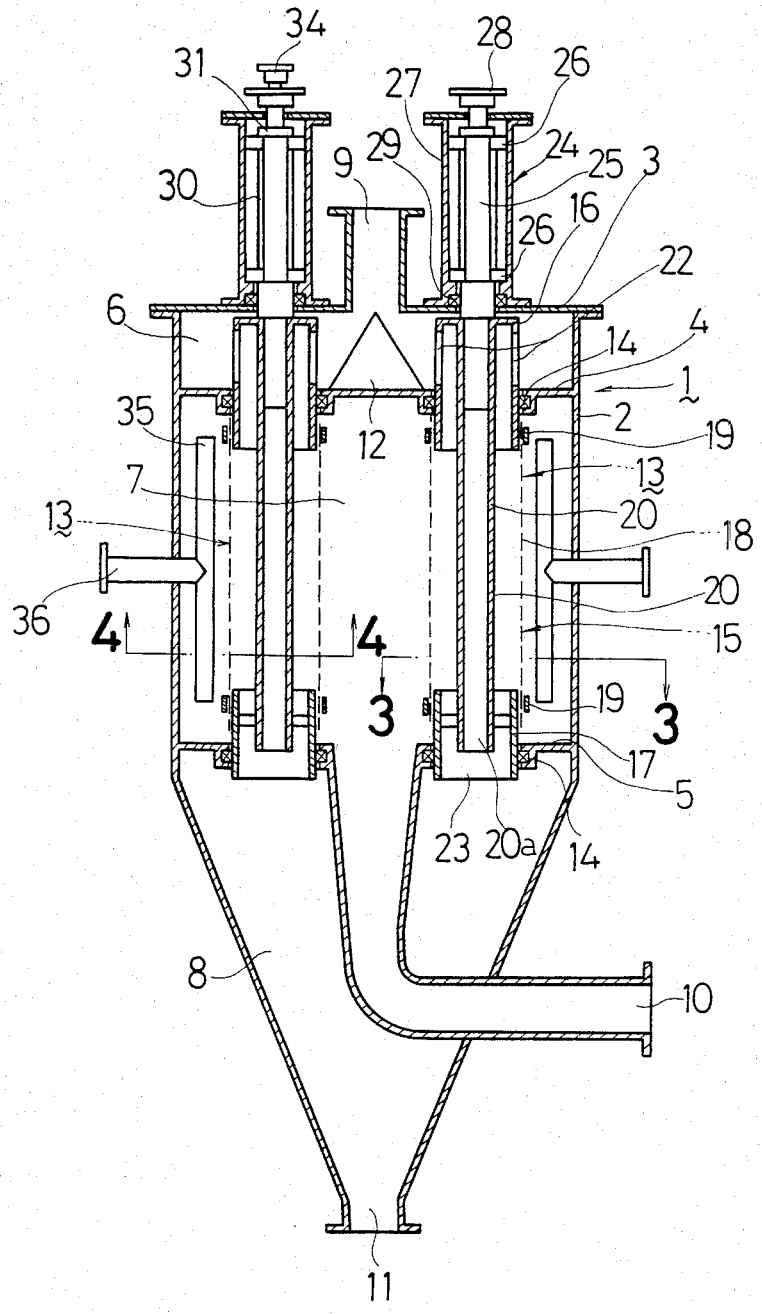
FIG. 1 is a vertical cross-sectional view of a classifier according to an embodiment of the present invention.

As shown in FIG. 1, a classifier according to an embodiment of the present invention comprises a casing 1 made of steel plate material and including an outer casing member 2 comprising an upper cylindrical portion and a lower conical portion which are integral with each other, with the upper culindrical portion being covered with a circular cover 3. The casing 1 is divided by horizontal partitions 4, 5 into material introduction chamber 6, a classification chamber 7, and a coarse particle chamber 8 arranged downwardly in succession. The cover 3 has a central inlet port 9 for introducing particulate matter to be separated into the material introduction chamber 6, the inlet port 9 opening upwardly. The partition 5 has an L-shaped outlet port 10 communicating with the classification chamber 7 and opening laterally outwardly of the coarse particle chamber 8. The casing 1 has an outlet port 11 communicating with the chamber 8 and opening downwardly for discharging coarse particles from the chamber 8. The outlet port 11 is in substantial axial alignment with the inlet port 9. While the casing 1 should preferably be circular in cross section for increased mechanical strength, it may be rectangular or polygonal in cross section to facilitate installation of the classifier.

A conical material distributor 12 is mounted on the partition 4 and disposed in the material introduction chamber 6 in confronting relation to the inlet port 9. The material distributor 12 serves to distribute particulate matter uniformly into classifying screen assemblies.

Figure 3:
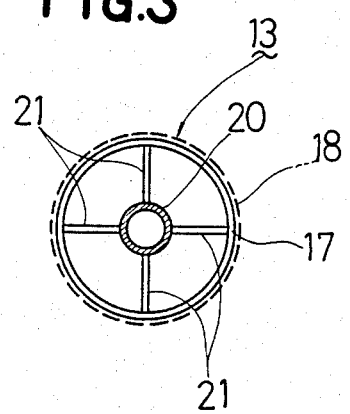
FIG. 3 is a cross-sectional view taken along line 3—3 of FIG. 1.
Figure 4:
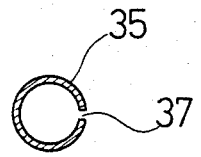
FIG. 4 is a cross-sectional view taken along line 4—4 of FIG. 1.

A plurality of angularly spaced classifying screen assemblies 13 are disposed in the casing 1 and extend substantially vertically through the partitions 4, 5. The classifying screen assemblies 13 are generally cylindrical in shape and are mounted on the partitions 4, 5 by airtight sealing mechanisms 14, 15 for rotation about their own axes. Each of the cylindrical screen assemblies 13 extends axially in the casing 1 substantially along the direction in which the particulate matter flows in the casing 1. Each of the cylindrical screen assemblies 13 comprises an upper cylindrical screen retainer 16 rotatably mounted on the partition 4, a lower cylindrical screen retainer 17 rotatably mounted on the partition 5, and a cylindrical screen 18 of wire net or filter cloth having a predetermined mesh and disposed around and fastened to the upper and lower screen retainers 16, 17 by strap bands 19, 19, respectively. The upper and lower screen retainers 16, 17 are interconnected by a smaller-diameter connector tube 20 extending coaxially therewith. The connector tube 20 is integral with the upper screen retainer 16, and coupled to the lower screen retainer 17 by a plurality of radial ribs 21 as shown in FIG. 3. The upper screen retainer 16 extends upwardly into the material introduction chamber 6 and has a plurality of radial holes 22 through its peripheral wall for introducing the particulate matter from the chamber 6 into the cylindrical screen assembly 13. The lower screen retainer 17 has a lower end opening into the coarse particle chamber 8 and hence serving as a hole 23 for discharging coarse particles from the screen assembly 13 into the coarse particle chamber 8. Thus, the material introduction chamber 6, the interior of the screen assembly 13, and the coarse particle chamber 8 are held in flow communication with each other through the holes 22, 23. The interior of the screen assembly 13 is held in flow communication with the outlet port 10 through the screen 18.

The connector tube 20 of each screen assembly 13 has a hollow or through bore **20*a* receiving in its upper end portion a lower end portion of a drive shaft 25 extending downwardly through the cover 3 from a drive mechanism 24 mounted on the cover 3. The screen assembly 13 is rotatably driven by the drive mechanism 24**.

The drive mechanism 24 comprises the drive shaft 25, a pair of upper and lower bearings 26, 26 by which the drive shaft 25 is rotatably supported, and a cylindrical housing 27 disposed on the cover 3 and supporting the upper and lower bearings 26, 26. The drive shaft 25 has on its upper end a sprocket 28 for corotation. The drive shaft 25 extends downwardly through the cover 3 with an airtight sealing mechanism 29 such as an oil seal being disposed around the drive shaft 25. A sleeve 30 is fitted over the drive shaft 25 for positioning the bearings 26, 26 thereon. The bearings 26, 26 are affixed to the drive shaft 25 by a nut 31.

Figure 2:
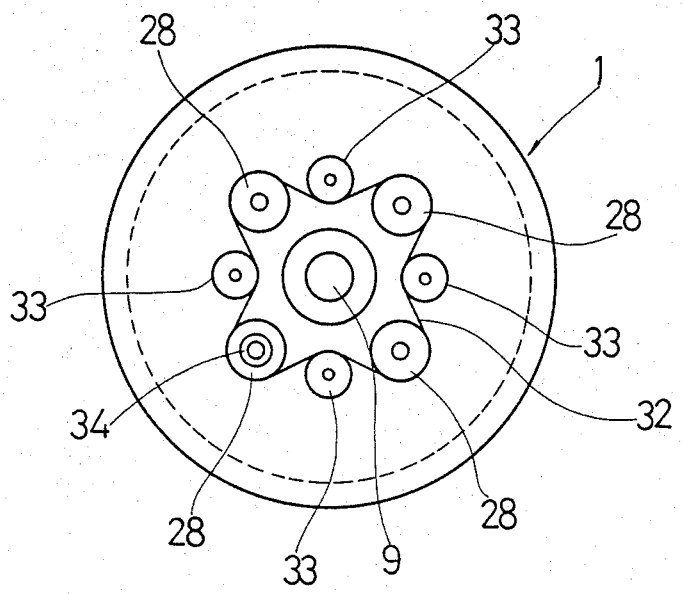
FIG. 2 is a plan view of the classifier shown in FIG. 1.

There are as many drive mechanisms 24 as there are classifying screen assemblies 13, and the drive mechanisms 24 are coupled respectively to the screen assemblies 13. As illustrated in FIG. 2, the drive mechanisms 24 are operatively coupled to each other by an endless chain 32 trained around the sprockets 28. A plurality of idlers 33 mounted on the cover 3 serve to tension the chain 32 to a suitable degree and to increase the angle through which the chain 32 is held in meshing engagement with each sprocket 28. One of the drive mechanisms 24 has on its sprocket 28 a drive sprocket 34 which is drivable by a motor or other suitable drive means (not shown).

A plurality of air purge pipes 35 are disposed in the casing 1 and extend axially of the casing 1 along the cylindrical screen assemblies 13. The air purge pipes 35 are located adjacent respectively to the screen assemblies 13 radially outwardly thereof. Each of the air purge pipes 35 is connected to a connector pipe 36 so as to be unitarily T-shaped as shown in FIG. 1. The air purge pipe 35 has upper and lower ends closed, and has a slot 37 (FIG. 4) extending axially in confronting relation to the screen 18. The connector pipe 36 is connected to a source of compressed air such as an air compressor (as shown at D in FIG. 5).

Figure 5:
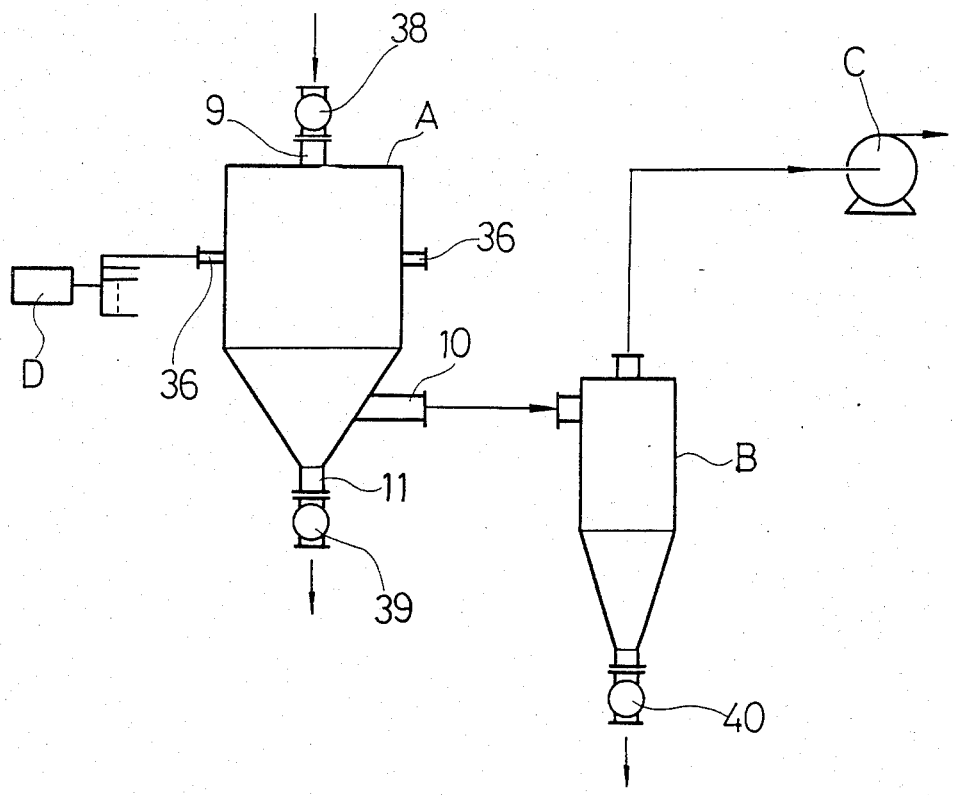
FIG. 5 is a diagrammatic view showing a process of classification.

A process of classification will be described with reference to FIG. 5.

Particulate matter to be classified is supplied in a predetermined amount from a hopper (not shown) through a rotary valve 38 and an inlet port 9 into a classifier A under suction forces produced by an air blower C. The particulate matter introduced into the classifier A is separated by a separation process (described hereinbelow) into coarse and fine particles. The coarse particles are discharged out of an outlet port 11, and collected from a rotary valve 39. The fine particles as mixed with air are introduced into a dust collector B such as a cyclone, in which the fine particles are separated from air. The separated particles are then discharged through a rotary valve 40, whereas the air is forced to flow out through the air blower C.

Operation of the classifier as illustrated in FIG. 1 will now be described.

Particulate raw material which comes through the inlet port 9 is uniformly distributed by the material distributor 12 into the screen assemblies 13 through the supply holes 22. Fine particles of a particle size smaller than the mesh of the screens 18 are allowed to pass therethrough and discharged out of the outlet port 10 together with air. Coarse particles that are too large to pass through the screens 18 drop by gravity through the holes 23 and are collected from the outlet port 11. At this time, the screens 18 tend to become clogged with such particles which have substantially the same particle size as the mesh of the screens 18 and are unable to find their way through the screens 18. However, such clogging particles are blown off the screens 18 by compressed air ejected from the air purge pipes 35 while the screen assemblies 13 are being rotated. Thus, the screens 18 are kept free of clogging, and enable the classifier to retain its desired separation capacity.

The cylindrical screen assemblies 13 are of increased mechanical strength and rigidity, and are prevented from mesh enlargement due to flexing of the screens 18, resulting in assurance of higher accuracy of classification. The cylindrical screen assemblies 13 are also advantageous in that they can provide a wide effective area available for screening, which leads to an increased processing capacity of the classifier. The cylindrical screen assemblies 13 extending parallel to each other take up a relatively small space within the classifier, which thus can be made small in size for increased handling capability.

Figure 6:
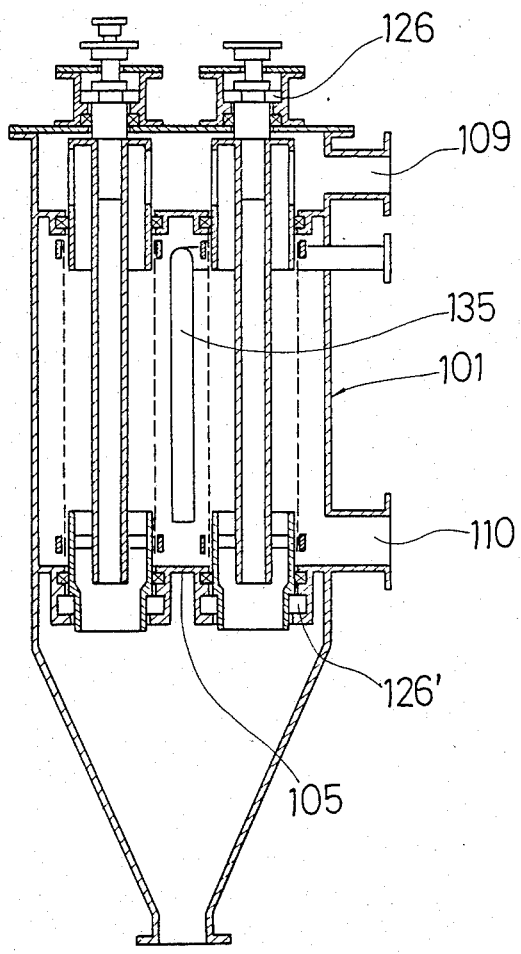
FIG. 6 is a vertical cross-sectional view of a classifier according to another embodiment of the invention.

FIG. 6 illustrates a classifier according to another embodiment of the invention. The classifier includes a plurality of screen assemblies each rotatably mounted on a casing 101 by a bearing 126 disposed in a drive mechanism and another bearing 126' mounted on a partition 105 in the casing 101. The casing 101 has a material introduction port 109 in its sidewall and a fine particle discharge port 110 opening directing outwardly of the casing 101 through the casing sidewall instead of the partition 105. A single air purge pipe 135 is disposed centrally in the casing 101, with the screen assemblies disposed around the air purge pipe 135 in angularly spaced relation. The classifier shown in FIG. 6 is smaller in size for the same separating capacity as that of the classifier illustrated in FIG. 1.

Figure 7:
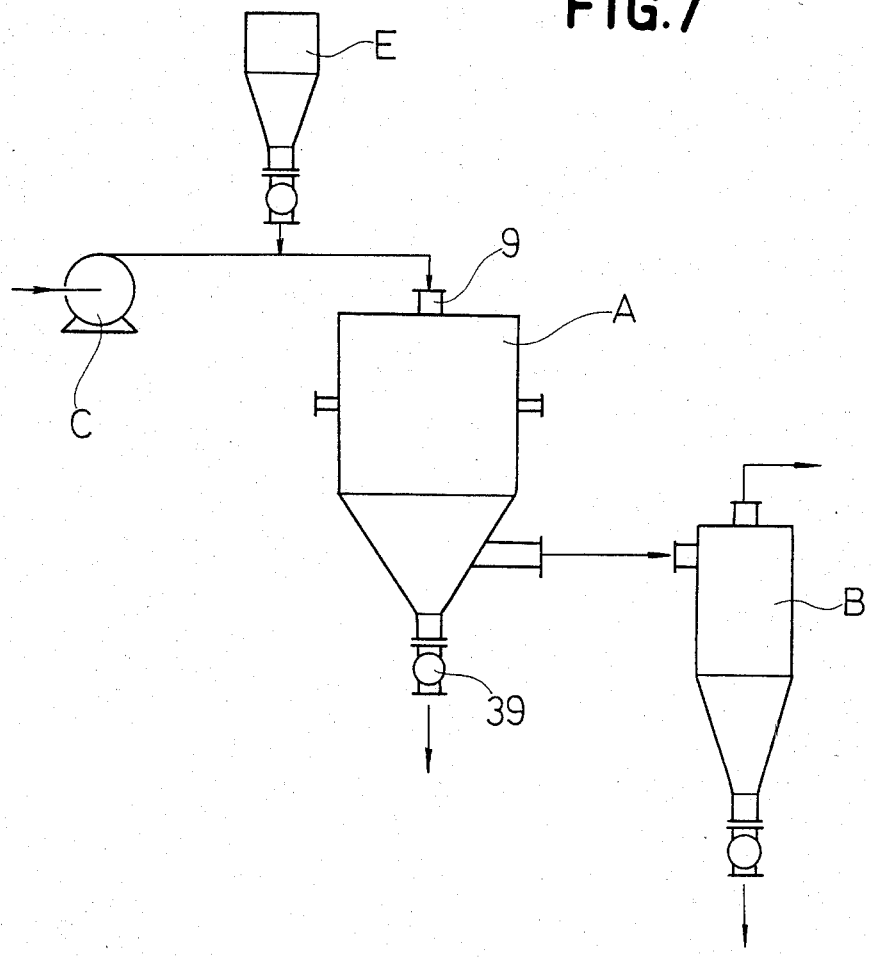
FIG. 7 is a diagrammatic view illustrative of another process of classification.

According to another classification process (FIG. 7), particulate matter is supplied from a hopper E into a classifier A under pressure developed by an air blower C installed upstream of a material introduction port 9 of the classifier A. Fine particles are fed under pressure from the classifier A into a dust collector B for separation from air. The classification process shown in FIG. 7 is thus carried out in a pressurization system. The process of classification illustrated in FIG. 5 is effected in a vacuumization system. Therefore, the classifier according to the present invention can be used in either a pressurization or a vacuumization system.

Figure 8:
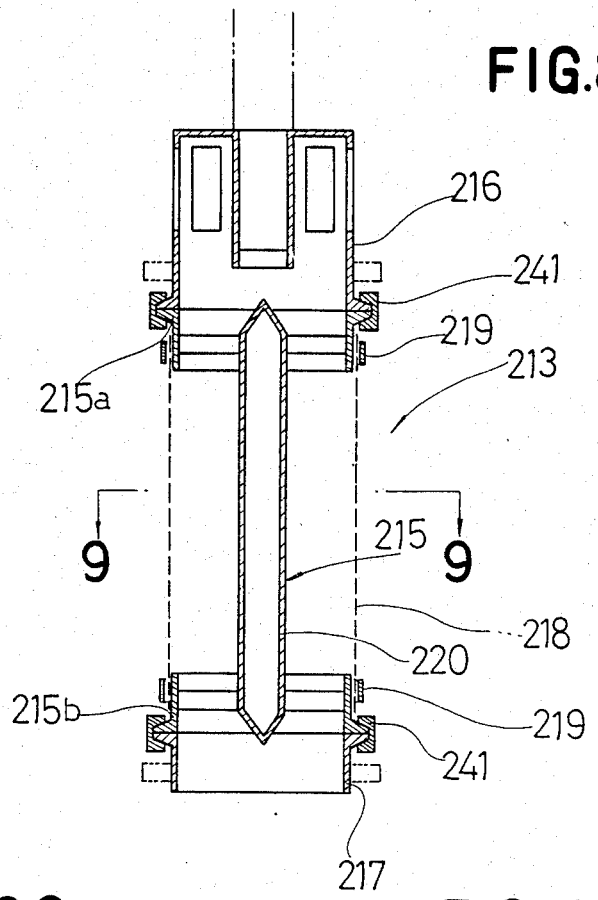
FIG. 8 is a vertical cross-sectional view of a modified classifying screen assembly.
Figure 9:
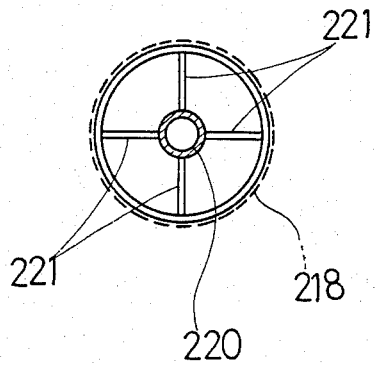
FIG. 9 is a cross-sectional view taken along line 9—9 of FIG. 8.

A classifying screen assembly 213 as shown in FIGS. 8 and 9 comprises an upper cylindrical screen retainer 216, a screen frame 215, and a lower cylindrical screen retainer 217, which are separably fastened together by fasteners 241, 241. The screen frame 215 comprises upper and lower cylindrical or annular members **215*a*, 215*b*, and an axial connector tube 220 connected at both ends thereof to the upper and lower members 215*a*, 215*b* by radial ribs 221. The screen frame 215 also includes a cylindrical screen 218 disposed around and attached to the annular members 215*a*, 215*b* by strap bands 219, 219, respectively. With this arrangement, the screen frame 215** can easily be replaced with another screen frame selected from a variety of such screen frames having screens of different meshes.

Figure 10:
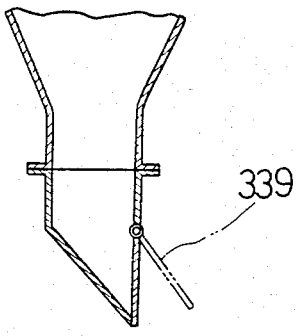
FIG. 10 is a vertical cross-sectional view of a discharge port structure for discharging coarse particles.

FIG. 10 illustrates a modified discharge or outlet port structure for discharging coarse particles out of a classifier. The outlet port structure has a swingable damper 339 pivotably mounted on the casing and normally closing an outlet port while no coarse particulate material is discharged therethrough under a vacuum developed within the casing. When coarse particles drop, the damper 339 is caused to swing open as indicated by the broken line due to the particles falling by gravity, thus allowing the coarse particles to be discharged from the casing. The damper 339 is employed in place of the rotary valve as illustrated in FIGS. 5 and 7, and is effectively used in the vacuumization system as shown in FIG. 7.

Figure 11:
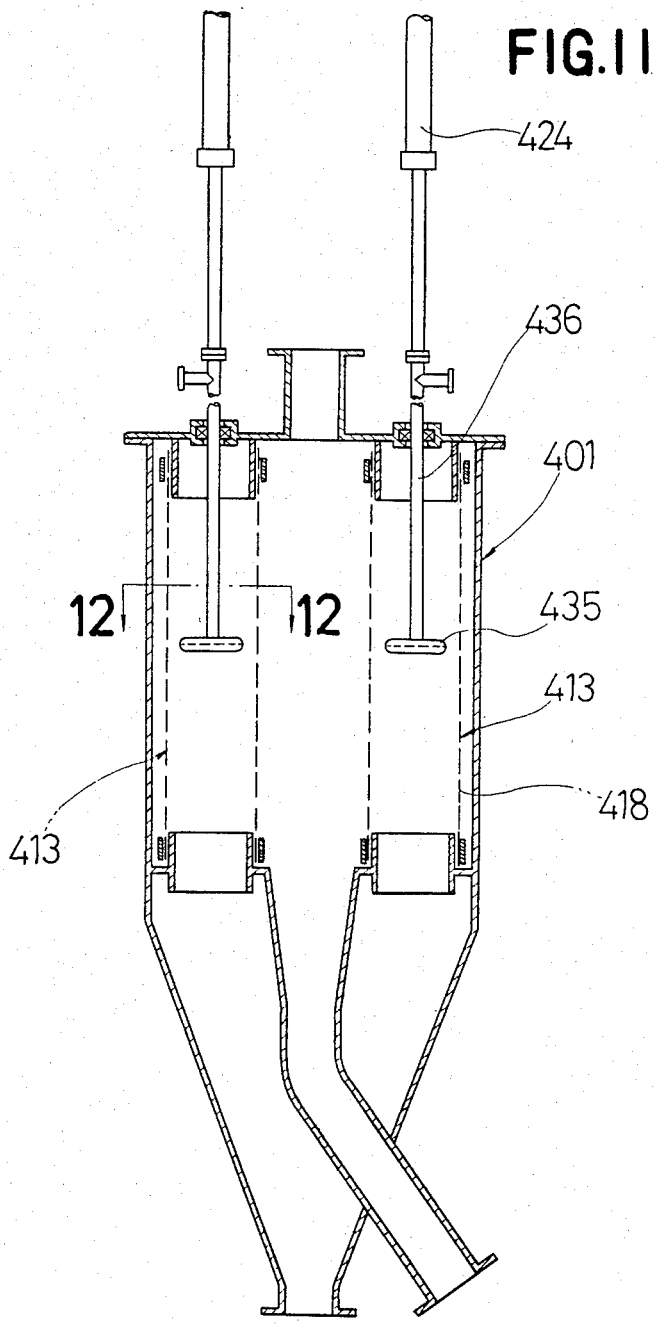
FIG. 11 is a vertical cross-sectional view of a classifier according to still another embodiment of the invention.
Figure 12:
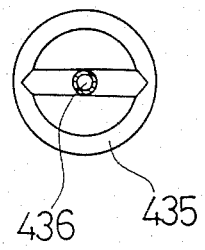
FIG. 12 is a cross-sectional view taken along line 12—12 of FIG. 11.

A classifier according to still another embodiment of the invention shown in FIGS. 11 and 12 comprises a plurality of classifying screen assemblies 413 fixedly mounted in a casing 401, and a plurality of air purge pipes 435 movably disposed respectively in the screen assemblies 413. Each of the air purge pipes 435 is in the form of a ring or an annular tube as shown in FIG. 12, and is fixed to a connector pipe 436 extending downwardly through the casing 413. The connector pipe 436 is operatively coupled to a drive mechanism 424 for moving the air purge pipe 435 up and down through the screen assembly 413. The connector pipe 436 is also connected to a source of compressed air (not shown). The air purge pipe 435 has an annular slot defined circumferentially in an outer peripheral wall thereof. As shown in FIG. 11, each air purge pipe 435 is separated from each associated screen assembly 413 such that the annular slot of pipe 435 is spaced a predetermined distance from the surface of the cylindrical screen of assembly 413, such predetermined distance being constant. When the drive mechanism 424 is actuated to move the air purge pipe 435 vertically, compressed air is ejected from the air purge pipe 435 against a screen 418 of the screen assembly 413 to blow particles off the screen 418 to thereby prevent the latter from being clogged by particles.

Figure 13:
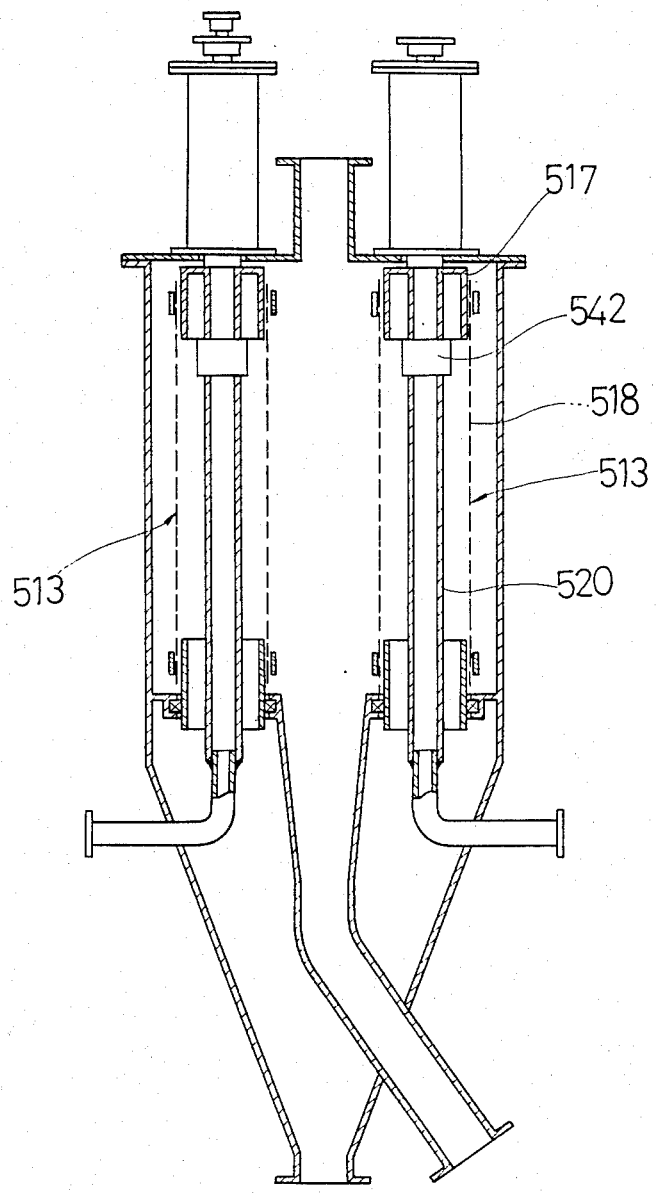
FIG. 13 is a vertical cross-sectional view of a classifier according to still another embodiment of the invention.

According to a still further embodiment of the invention as shown in FIG. 13, a plurality of classifying screen assemblies 513 are rotatably mounted in a casing and each have a connector tube 520 extending through the screen assembly 513 and fixed thereto by a rotary joint 542. The connector tube 520 has an axial slot facing a screen 518 of the screen assembly 513. The connector tube 520 is connected to a source of compressed air for supplying a stream of air under pressure through the slot in the connector tube 520 into the screen assembly 513. Thus, any particles are blown off the screen 518 by the air stream from the connector tube 520 while the screen assembly 513 is rotating. The connector tube 520 therefore serves as an air purge tube. The connector tube 520 may be connected to upper and lower screen retainers 517, 519 through ribs for reinforcement of the screen assembly 513.

Figure 14:
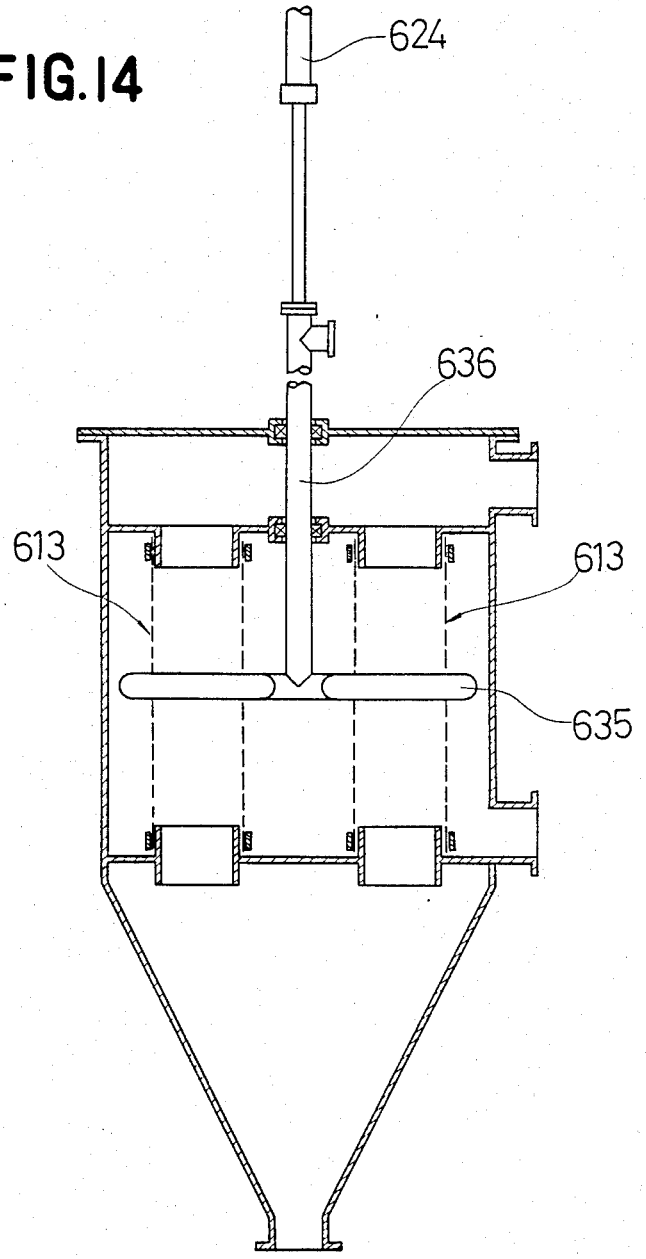
FIG. 14 is a vertical cross-sectional view of a classifier according to a still further embodiment of the invention.

In FIG. 14, a classifier according to a still further embodiment of the invention includes a plurality of fixed screen assemblies 613, and a plurality of annular air purge pipes 635 disposed circumferentially around the screen assemblies 613, respectively. The air purge pipes 635 are connected to a common connector pipe 636 which is operatively connected to a drive mechanism 624 for moving the connector pipe 636 up and down, and which is also coupled to a suitable source of compressed air. Each of the annular air purge pipes 635 has an annular slot extending fully circumferentially in its inner periphery wall facing the screen assembly 613. Each air purge pipe 635 is separated from each associated screen assembly 613 such that the annular slot of pipe 635 is spaced a predetermined distance from the surface of the cylindrical screen of assembly 613, such predetermined distance being constant. While the air purge pipe 635 move up and down, compressed air is forced from the air purge pipes 635 against the screen assemblies 613 to blow any particles off the latter.

Although certain perferred embodiments have been shown and described in detail, it should be understood that various changes and modifications may be made without departing from the scope of the appended claims.

What is claimed is:

1. A classifier for separating particulate matter into relatively coarse and fine particles, comprising:

a casing adapted to permit said particulate matter to flow therein along a predetermined direction;

said casing including at least one inlet port, at least one course particle outlet port, and at least one fine particle outlet port, said ports being separated from each other;

at least one cylindrical screen assembly stationarily mounted in said casing, said cylindrical screen assembly including a cylindrical screen extending substantially axially along said predetermined direction so as to force the fine particles to traverse said cylindrical screen so as to be separated from the coarse particles;

said inlet port of said casing communicating with the interior of each said screen through an upper opening thereof, said coarse particle outlet port of said casing communicating with the interior of each said screen through a lower opening thereof, and said fine particle outlet port of said casing communicating with the interior of said screen through the mesh of said screen;

at least one air purge pipe disposed in said casing and connected to a source of compressed air, said air purge pipe having an opening facing the outer surface of said cylindrical screen assembly so as to blow particles off said screen assembly to prevent clogging thereof;

said air purge pipe being separated from said screen assembly such that said opening of said air purge pipe is spaced a predetermined distance from the surface of said cylindrical screen, said predetermined distance between said opening of said air purge pipe and said surface of said cylindrical screen being constant;

said air purge pipe being in the form of an annular tube; and drive means for moving said air purge pipe along the length of said cylindrical screen so that the entire surface area of said screen may be exposed to said blowing by said air purge pipe.

2. A classifier according to claim 1, wherein:

said casing includes a swingable damper for normally closing said coarse particle outlet port, said swingable damper being openable when the coarse particles are discharged out of said outlet port due to gravity.

3. A classifier according to claim 1, wherein:

each said cylindrical screen includes an uppermost end and a lowermost end, said ends being airtightly sealed at peripheral portions thereof to upper and lower apertured partitions so as to prevent a direct flow of said particulate matter from the interior of said screen to the exterior thereof.

4. A classifier according to claim 1, wherein:

said cylindrical screen assembly comprises a pair of axially spaced screen retainers supported on said casing and a cylindrical screen fastened at its axial ends to said screen retainers.

5. A classifier according to claim 1, wherein:

said drive means comprises a connector pipe fixed to said air purge pipe, said connector pipe being operatively coupled to a drive mechanism for moving said air purge pipe along the length of said screen.

6. A classifier according to claim 1, wherein:

said annular air purge pipe is disposed circumferentially around said cylindrical screen; and said opening is in the form of an annular slot defined in an inner peripheral wall of said annular tube in confronting relation to the outer cylindrical surface of said cylindrical screen.

7. A classifier according to claim 6, wherein:

a plurality of said cylindrical screen assemblies are stationarily mounted in said casing; and said classifier includes a plurality of said air purge pipes, equal in number to said plurality of screen assemblies, each said air purge pipe being respectively operably disposed around one of said screen assemblies.

8. A classifier according to claim 7, wherein:

said drive means comprises a common connector pipe to which each of said air purge pipes is connected, said common connector pipe being operatively connected to a drive mechanism for moving said connector pipe and said air purge pipes connected thereto along the length of said screen.

* * * * *